United States Patent [19]

Freisinger et al.

[11] Patent Number: 4,756,545

[45] Date of Patent: Jul. 12, 1988

[54] SAFETY SKI BINDING

[75] Inventors: Henry Freisinger; Stritzl Karl, both of Vienna, Austria

[73] Assignee: TMC Corporation, Baar, Switzerland

[21] Appl. No.: 860,638

[22] Filed: May 7, 1986

[30] Foreign Application Priority Data

Jul. 5, 1985 [AT] Austria ..... 2005/85

[51] Int. Cl.[4] ..... A63C 9/081

[52] U.S. Cl. ..... 280/618; 280/626; 280/628; 280/631

[58] Field of Search ..... 280/618, 626, 628, 629, 280/631, 633

[56] References Cited

U.S. PATENT DOCUMENTS

| | | | |
|---|---|---|---|
| 3,921,997 | 11/1975 | Begey et al. | 280/633 |
| 4,088,342 | 5/1978 | Hausleithner | 280/614 |
| 4,277,083 | 7/1981 | Himmetsberger et al. | 280/618 |
| 4,294,461 | 10/1981 | Eckart | 280/618 |
| 4,620,718 | 11/1986 | Stritzl | 280/633 |

FOREIGN PATENT DOCUMENTS

| | | | |
|---|---|---|---|
| 316386 | 10/1974 | Austria . | |
| 367642 | 7/1982 | Austria . | |
| 2308602 | 8/1974 | Fed. Rep. of Germany | 280/618 |
| 2342378 | 2/1975 | Fed. Rep. of Germany | 280/633 |
| 2510385 | 10/1975 | Fed. Rep. of Germany . | |
| 2756897 | 8/1978 | Fed. Rep. of Germany | 280/618 |
| 2851634 | 6/1980 | Fed. Rep. of Germany . | |
| 3102010 | 9/1982 | Fed. Rep. of Germany . | |
| 3146876 | 10/1982 | Fed. Rep. of Germany | 280/633 |

*Primary Examiner*—John J. Love
*Assistant Examiner*—Eric Culbreth
*Attorney, Agent, or Firm*—Flynn, Thiel, Boutell & Tanis

[57] ABSTRACT

A safety ski binding provided with a sole plate supported pivotally on a ski-fixed pivot, however, is secured against lifting off from the ski carries at its rear end a heel holder and at its front end a front jaw. The front jaw is pivotal about a transverse axle and carries a control element extending in the longitudinal direction of the ski in the skiing position. On the front end of the control element is supported rotatably a roller, with which is associated a cam secured on the ski, which cam, upon reaching a predetermined angle of traverse of the sole plate relative to the longitudinal direction of the ski, permits a pivoting of the front jaw in the sense of a release of the ski shoe. In order to permit in such a ski binding a storing of the cam protected against dirt, the invention provides that the cam (2f) for the roller (15) of the control element (14) is stored in a housing (2,7) which is open only toward the tail end of the ski and serves to support the front jaw (10,17).

8 Claims, 5 Drawing Sheets

SAFETY SKI BINDING

FIELD OF THE INVENTION

The invention relates to a safety ski binding pivotal about a vertically upright axle and effecting a ski shoe release in response to a pivotal movement beyond a predetermined angle with respect to a longitudinal axis of a ski.

BACKGROUND OF THE INVENTION

Such a ski binding is described in German OS No. 31 02 010. The cam and the roller of the known design are practically not protected toward the outside, which can cause ice and dirt to build up. As soon as the roller has left the cam, the front jaw can swing toward the tip of the ski and thus release the ski shoe.

A similar design is disclosed in Austrian Patent No. 316 386. In this construction of a front jaw, the sole plate is replaced with a joint parallelogram, which in its function is similar to the function of a pivotal sole plate. At a certain angle of deflection of the guide rods, a swinging of the front jaw, which in the skiing position is supported on a ski-fixed bearing block, is here also possible. A roller does not exist in this design. Rather, the surfaces of the front jaw and of the bearing block slide on one another during a deflection of the front jaw and are not protected toward the outside. Thus dirt can accumulate here also, which jeopardizes the function of the front jaw.

The goal of the invention is to overcome the disadvantages of the known devices and to provide a safety ski binding, the front jaw of which is constructed such that the elements needed for its control are protected toward the outside to prevent dirt accumulation.

SUMMARY OF THE INVENTION

A safety ski binding provided with a sole plate supported pivotally on a ski-fixed pivot, however, is secured against lifting off from the ski, carries at its rear end a heel holder and at its front end a front jaw. The front jaw is pivotal about a transverse axle and carries a control element extending in the longitudinal direction of the ski in the skiing position. On the front end of the control element is supported rotatably a roller, with which is associated a cam secured on the ski, which cam, upon reaching a predetermined angle of traverse of the sole plate relative to the longitudinal direction of the ski, permits a pivoting of the front jaw in the sense of a release of the ski shoe. In order to permit in such a ski binding a storing of the cam protected against dirt, the invention provides that the cam for the roller of the control element is stored in a housing which is open only toward the tail end of the ski and serves to support the front jaw.

BRIEF DESCRIPTION OF THE DRAWINGS

The drawings illustrate purely schematically an exemplary embodiment of the subject matter of the invention.

DETAILED DESCRIPTION

Figure 1:
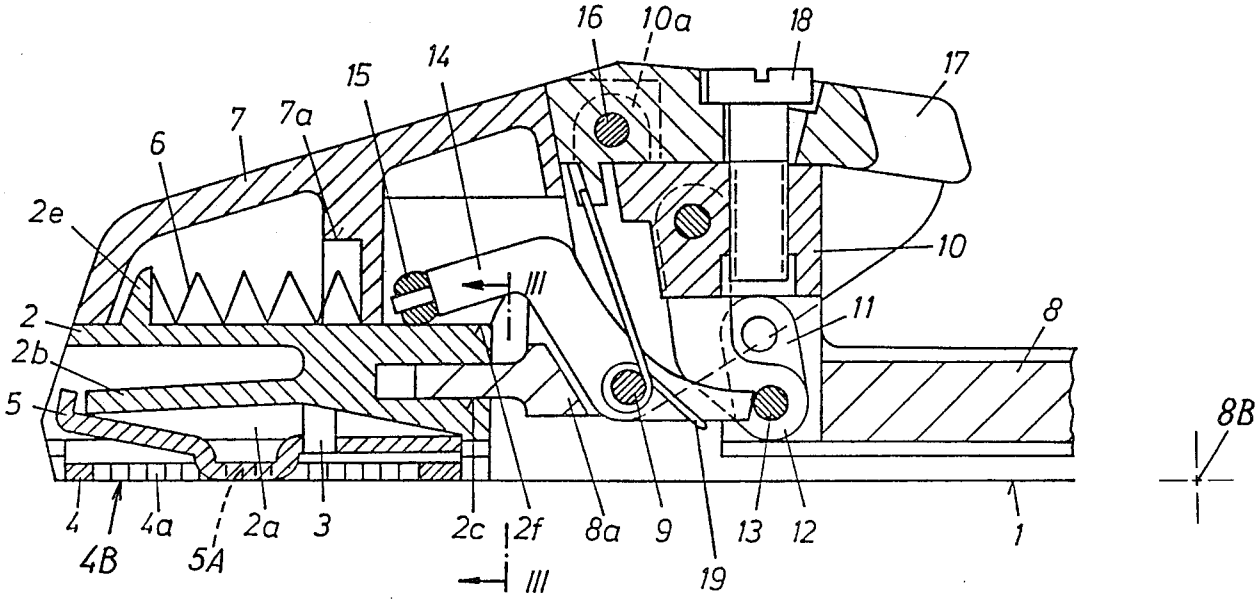
FIG. 1 is a longitudinal cross-sectional view of the front jaw in the skiing position.

The lower part 2 of a housing 2, 7 of elastic plastic is secured to the upper side 1 of a ski. The lower part 2 has a cavity 2*a* therein which is open toward the ski and into which projects a peg 3 which is attached to the lower part. A rail 4 is secured to the upper side 1 of the ski below the cavity 2*a*. The rail 4 is constructed frame-shaped, a longitudinally central section of it being shown in FIG. 1. The longitudinal sides, one of which is shown as 4B in FIG. 1, have inwardly directed racks or rows of teeth 4*a* therein. Flanges (not shown) are attached to the longitudinal sides. The lower part 2 is guided in longitudinal direction of the ski on the flanges (also not shown).

A resilient locking member 5 is provided in the cavity 2*a*, which locking member 5 has a hole therein into which is received peg 3. If the lower part 2 is supposed to be adjusted in a longitudinal direction of the ski, then the locking member 5, which engages with its locking teeth 5A the racks or rows of teeth 4*a* of the rail 4, is lifted with a screwdriver, which is pressed in between the locking member 5 and the rail, so that the connection between the locking teeth 5A of the locking member 5 and the racks 4*a* of the rail 4 is released. The lower part 2 is subsequently moved. As soon as the desired position of the lower part 2 relative to the ski is reached, the screwdriver is pulled out of the gap between the rail 4 and the underside of the locking member 5, and the locking teeth of the locking member 5 again engage the racks 4*a* of the rail 4. In order to assure the latter, the locking member 5 is loaded by a resilient tongue 2*b*, which is constructed in one piece with the lower part 2.

A groove 2*c* which is rectangular in cross section is recessed in the sidewall of the lower part 2, which sidewall is the right one in FIG. 1. The purpose of the groove 2*c* will be discussed later on. The longitudinal sidewalls of the lower part 2 carry guide grooves 2*d* (see FIG. 3). A support 2*e* for a pressure spring 6 is attached to the upper side of the lower part 2. In the area of the end, namely the right end in FIG. 1, the lower part 2 carries a cam 2*f* which is circular in the top view.

An upper part 7 also made of plastic is guided in a longitudinal direction of the ski on the lower part 2 by movable supporting bars mounted on the upper part in the grooves 2*d* of the lower part 2. The upper part 7 is under the influence of the spring 6, which urges it to the right in FIG. 1, one end of which is received in a recess 7*a* of the upper part 7. The upper part 7 only has the purpose to cover the cam 2*f* of the lower part 2, so that a gap is created neither in the skiing position nor during the release operation, which gap would permit the penetration of snow or dirt toward the cam 2*f*.

The ski binding furthermore has a sole plate 8, which can pivot about a vertical axis 8B. The axis 8B is located approximately on an extension of the lower leg bone of the skier. A heel holder (not shown) which is not the subject matter of the invention is located at the end of the sole plate 8, which end is adjacent the tail end of the ski.

The sole plate 8 is guided by means of at least one shoulder 8*a* in the groove 2*c* of the lower part 2. The shoulder 8*a* is arranged at the front end. The sole plate 8 carries in the area which is connected to the shoulder 8*a* a transverse axle 9 on which is pivotally supported a front jaw with its housinglike lower support part 10. The lower support part 10 is, spaced from the transverse axle 9, connected to the sole plate 8 through a toggle lever mechanism. The toggle-lever mechanism consists of two pairs of toggle levers 11 and 12 arranged spaced from a vertical plane of symmetry and are hinged to one another by an axle 13. The axle 13 thereby forms the toggle joint. The one toggle lever 12 of each pair is hinged to the lower support part 10 and the other toggle lever 11 to the sole plate 8 or on a bearing block (not shown) secured to the sole plate.

Figure 3:
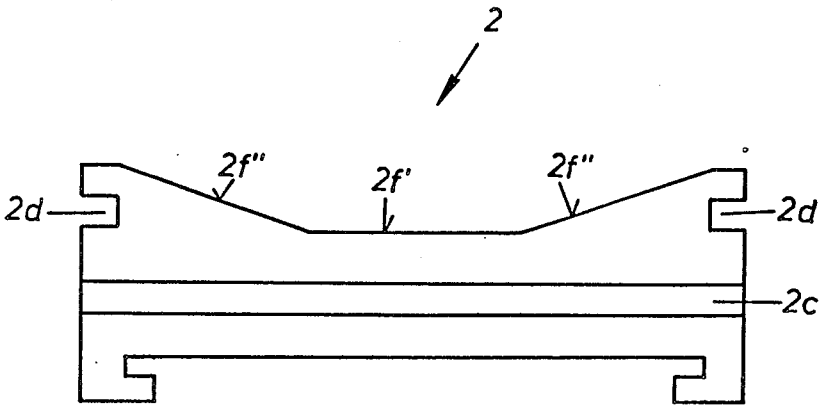
FIG. 3 is a front view of the cam in direction of the arrows III—III of FIG. 1.

A control element 14 which is constructed as an angle lever is furthermore pivotally supported on the transverse axle 9 in the vertical longitudinal center plane. One lever arm of the control element rests under the influence of a spring 19 through a roller 15 on the cam 2*f*, whereas the other lever arm, in the skiing position, secures the axle 13 of the toggle-lever mechanism against swinging. The spring 19 is a torsion spring, which is supported on the transverse axle 9. The cam 2*f*, on which the roller 15 is supported, has a center section 2*f'*, which extends parallel with respect to the upper side of the ski, and two branches 2*f''*, which follow the section 2*f'* and diverge upwardly (FIG. 3.).

In order to be able to adjust the front jaw to shoe soles of different thicknesses, the lower support part 10 is provided on the upper side with bearing eyes 10*a* in which an axle 16 is supported. The axle is the pivot axle for a sole holder 17, which is under the influence of a spring (not shown) and which tends to pivot the said sole holder counterclockwise in FIG. 1. The position of the sole holder 17 is adjusted by an adjusting screw 18 which extends through a slotted hole in the sole holder and is screwed into a tapped hole in the lower support part 10 of the front jaw.

Figure 2:
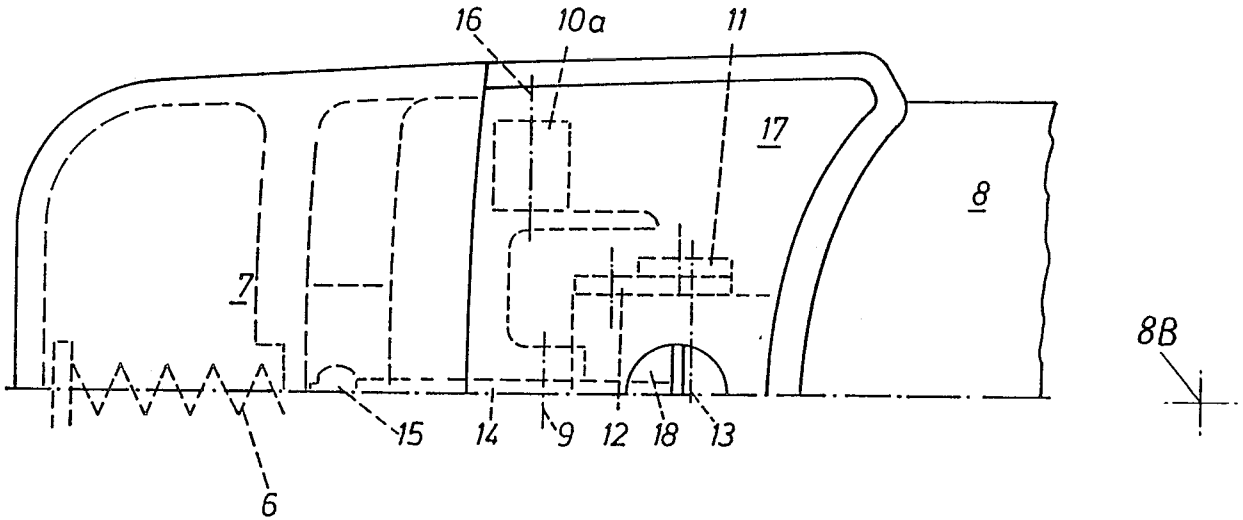
FIG. 2 is an associated partial top view.
Figure 4:
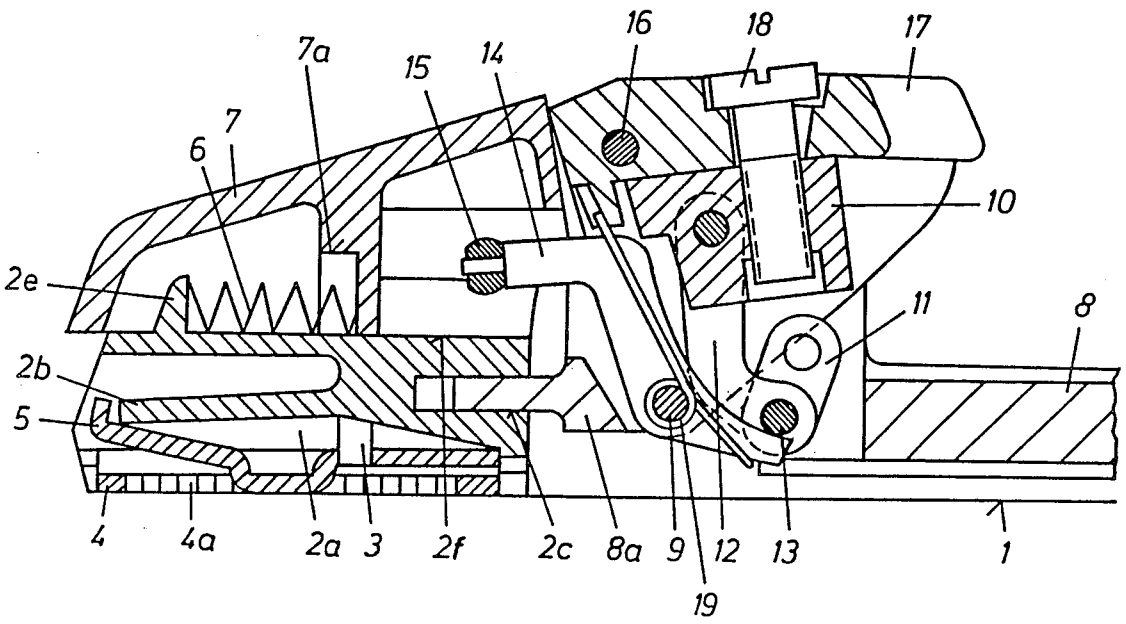
FIG. 4 is a cross-sectional view taken along the line IV—IV of FIG. 5 of the front jaw in deflected position and FIG. 5 is an associated partial top view.
Figure 5:
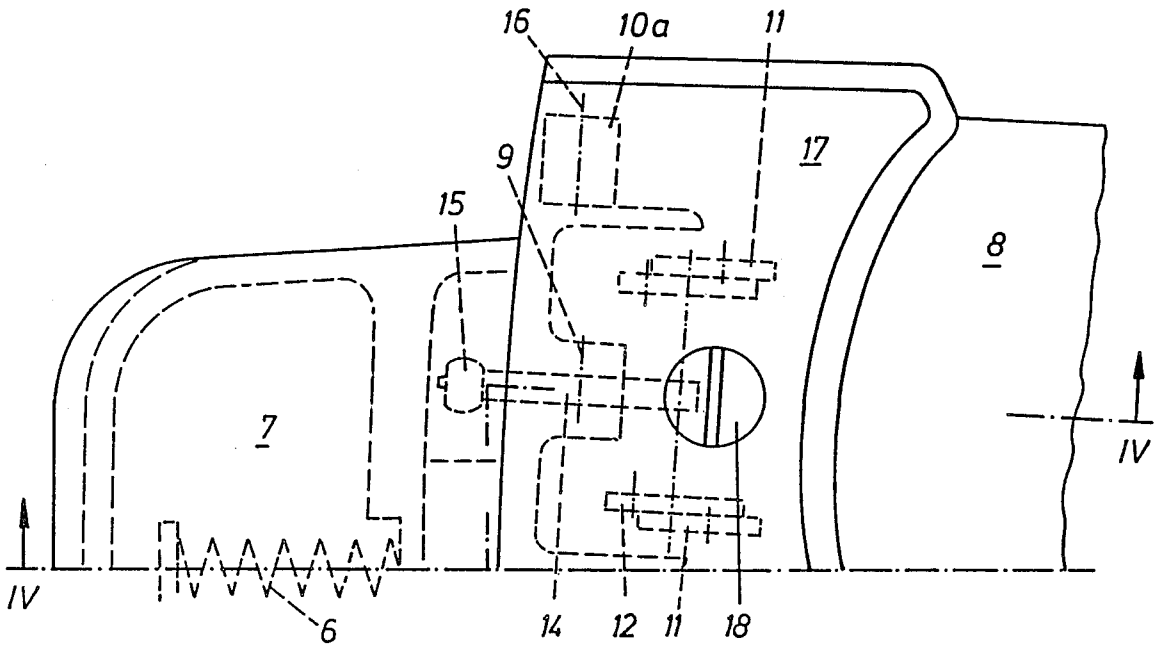

The ski binding assumes in the skiing position the position illustrated in FIGS. 1 and 2, in which the roller 15 is in the center section 2*f'* of the cam 2*f*. If, however, during skiing, there occurs a lateral deflection of the sole plate 8, which exceeds the elastic range defined by the center section 2*f'* of the cam 2*f*, the roller 15 is lifted by one of the two inclined branches 2*f''* of the cam 2*f*. The angled lever 14 is through this, however, pivoted clockwise, and the axle 13 is released. This, however, has the result, that the two levers 11 and 12, which are arranged on each side of the ski and which first were in the fully extended position, can move under the influence of the force applied by the ski shoe into an angled position, which permits a counterclockwise pivoting of the front jaw 10, 17 (see FIG. 4). The ski shoe is thereby released. The upper part 7 of the housing 2,7 is thereby at the same time moved against the force of the spring 6 from the front jaw 10, 17 toward the tip of the ski.

Following a completion of the release operation, the sole plate 8 is pivoted back by a spring system installed in the not illustrated heel holder, and the remaining elements return into the initial position illustrated in FIGS. 1 and 2.

The embodiments of the invention in which an exclusive property or privilege is claimed are defined as follows:

1. In a safety ski binding comprising a sole plate which is pivotally supported on a ski-fixed pivot with means being provided for preventing said sole plate from lifting off from said ski, said sole plate having a housing means defining a housing at a front end of said sole plate, said housing means having a front jaw which is pivotal between a ski shoe holding position and a ski shoe releasing position about a transverse axis on said housing means and carries a control element which extends in a longitudinal direction of said ski when in said ski shoe holding position, on a front end of which control element a roller is rotatably supported, with which roller is associated a cam secured on said ski, which cam upon reaching a predetermined angle of traverse of said sole plate relative to the longitudinal direction of said ski permits a pivoting of said front jaw to said ski shoe releasing position, wherein the improvement comprises means within said housing means defining an enclosed space and an opening opening outwardly only in a direction toward said sole plate, said cam and operatively engaging roller being oriented within said enclosed space, said control element extending rearwardly through said opening, means on a rear end of said control element for initially blocking movement of said front jaw from said ski shoe holding position to said ski shoe releasing position, said cam and operatively engaging roller, upon said sole plate reaching said predetermined angle of traverse relative to the longitudinal direction of said ski, causing said means on said rear end of said control element to move to unblock movement of said front jaw to facilitate a free and unobstructed movement thereof about said transverse axis toward said ski shoe releasing position.

2. The ski binding according to claim 1, wherein said housing is divided into an upper part and a lower part, said lower part being ski-fixed in ski shoe holding position, said upper part being under the influence of at least one spring tending to press said upper part against said front jaw.

3. The ski binding according to claim 1, wherein said housing is provided with a groove which extends in transverse direction parallel to the upper side of the ski and has a rearwardly facing upright wall the top view, in which groove is guided at least one shoulder of said sole plate.

4. The ski binding according to claim 1, wherein said control element is an angled lever which is under the influence of a spring, said spring urging said roller against said cam, said lever being pivotally supported on said transverse axle of said front jaw.

5. The ski binding according to claim 4, wherein said angled lever rests on a toggle joint of a pair of toggle levers, one of said toggle levers being hinged by a first hinge means to said front jaw and an other of said toggle levers being hinged by a second hinge means to said sole plate.

6. The ski binding according to claim 1, wherein said cam includes a center section which is parallel with respect to the upper side of the ski and two upwardly diverging laterally extending cam branches on laterally opposite sides of said center section.

7. The ski binding according to claim 2, wherein said lower part of said housing includes a ski-fixed rail for supporting said lower part for frontward and rearward movement to facilitate an adjustment of said front jaw relative to said heel holder to enable an accommodating of different sized ski shoes with said ski binding, said rail being provided in the area of its longitudinal sides with rows of teeth which are opposing one another, whereby for fixing said lower part of said housing with respect to said rail, a locking member provided with locking teeth is inserted between said lower part and said rail with said locking teeth engaging selected ones of said teeth in said rows of teeth.

8. The ski binding according to claim 7, wherein said locking member is urged toward said rail by a resilient tongue integrally formed on said lower part of said housing, said lower part being made of plastic.

* * * * *